United States Patent [19]

Knemeyer

[11] Patent Number: 4,995,166

[45] Date of Patent: Feb. 26, 1991

[54] ARCHERY BOW RANGE FINDER AND SIGHT

[76] Inventor: Loren A. Knemeyer, 200 Rimrock Way Southeast, East Wenatchee, Wash. 98802

[21] Appl. No.: 526,072

[22] Filed: May 18, 1990

[51] Int. Cl.[5] ..... F41G 1/46

[52] U.S. Cl. ..... 33/265

[58] Field of Search ..... 33/265; 124/87; 356/21

[56] References Cited

U.S. PATENT DOCUMENTS

| | | | |
|---|---|---|---|
| 2,767,472 | 10/1956 | Kocur . | |
| 2,863,325 | 12/1958 | Eisenberg et al. . | |
| 2,998,652 | 9/1961 | Zielinski . | |
| 3,056,206 | 10/1962 | Moore . | |
| 3,666,368 | 5/1972 | Sprandel . | |
| 3,766,656 | 10/1973 | Westphal . | |
| 3,910,700 | 10/1975 | Sprandel . | |
| 4,195,414 | 4/1980 | Robinson . | |
| 4,584,777 | 4/1986 | Saunders . | |
| 4,669,196 | 6/1987 | Kersey | 33/265 |
| 4,711,036 | 12/1987 | Morris . | |

*Primary Examiner*—Harry N. Haroian

*Attorney, Agent, or Firm*—Ward Brown; Robert W. Beach

[57] ABSTRACT

A sight pin and top and bottom range finder pins are mounted on a slide movable vertically relative to the handle of an archery bow. The slide has mechanism for moving the range finder pins equally toward the sight pin or away from it as the slide is moved. The amount of increase or decrease in the spacing between the range finder pins for a given length of travel of the slide can be adjusted and can be different for different ranges of vertical travel of the slide.

13 Claims, 3 Drawing Sheets

ARCHERY BOW RANGE FINDER AND SIGHT

BACKGROUND OF THE INVENTION

1. Field of the Invention

The present invention relates to a combined range finder and sight for an archery bow.

2. Prior Art

Known bow sights are disclosed in the following U.S. Pat. Nos.:

No. 2,767,472, issued Oct. 23, 1956 (Kocur);
No. 2,863,325, issued Dec. 9, 1958 (Eisenberg et al.);
No. 2,998,652, issued Sept. 25, 1961 (Zielinski);
No. 3,056,206, issued Oct. 2, 1962 (Moore);
No. 3,666,368, issued May 30, 1972 (Sprandel);
No. 3,766,656, issued Oct. 23, 1973 (Westphal);
No. 3,910,700, issued Oct. 7, 1975 (Sprandel);
No. 4,195,414, issued Apr. 1, 1980 (Robinson);
No. 4,584,777, issued Apr. 29, 1986 (Saunders);
No. 4,711,036, issued Dec. 8, 1987 (Morris).

In each of the devices disclosed in the above patents, the position of a sight pin or bead is adjustable vertically along the handle section of the bow. With the bow held at arm's length, positioning the sight pin or bead at a lower level requires that the bow be moved upward to align the pin or bead with the target. Such upward movement is accomplished by swinging motion of the bow about the shoulder of the supporting arm of the archer, resulting in a greater angle of trajectory of the arrow which corresponds to a target farther from the archer. Similarly, positioning the sight pin at a higher level requires that the bow be swung downward to align the sight pin or bead with the target, corresponding to a lesser angle of trajectory for a closer target.

Some of the devices of the above patents have or are used with range finders. Known range finders utilize vertically spaced range finder pins. The apparent size of the target between the pins gives an approximation of the distance to the target. For example, a circular target of a known size or the body of an animal stalked by a game hunter may appear to fill the space between selected range finder pins at a known distance. At a lesser distance the target would appear to be larger than the spacing between the pins, and accurate aiming would require a reduced angle of trajectory which could be accomplished by selecting a higher sight pin or bead or by moving the sight pin or bead to a higher level on the handle of the bow. At a greater distance the target would appear to be smaller than the spacing between the pins, and the angle of trajectory of the arrow should be increased, which could be accomplished by selecting a lower sight pin or bead or by moving the sight pin or bead to a lower level on the handle of the bow.

The actual sighting procedure is more complicated because the archer must take into consideration cross wind and headwind or tail wind, the weight of the arrow, type of arrow (air resistance) and any other factor which would tend to alter the flight of the arrow. For example, in most of the devices disclosed in the above patents, the position of a sight pin or bead can be adjusted transversely to compensate for the arm position of the individual marksman and the effect of cross wind on the type of arrow being used.

Of the devices disclosed in the above patents, it is believed that those described in the two patents issued to Sprandel are most pertinent to the present invention because in each instance range finder pins are movable vertically relative to a bow handle (manually in the construction of U.S. Pat. No. 3,666,368 and by a motor in the construction of U.S. Pat. No. 3,910,700) and some adjustment of the spacing between the pins occurs as they are moved.

SUMMARY OF THE INVENTION

The principal object of the present invention is to provide an improved range finder and sight for an archery bow by which the bow can be quickly and reliably positioned by an archer to result in accurate launching of an arrow to strike an intended target with minimal mental calculation being required by the archer.

It also is an object to provide such an improved range finder and sight which can be adjusted to accommodate for the different sizes and stances of different archers; and which can be adjusted to accommodate for different conditions faced by the same archer.

Another object is to provide such an improved range finder and sight in a form mountable on standard bows by standard mounting brackets and in a form which is easy to use.

In accordance with the present invention, the foregoing objects are accomplished by providing a combined range finder and sight having a sight pin positioned between top and bottom range finder pins, all of such pins being mounted on a slide movable vertically relative to the handle and having mechanism for moving the range finder pins equally toward the sight pin or away from it as the slide is moved. In the preferred embodiment, the amount of increase or decrease in the spacing between the range finder pins for a given length of travel of the slide can be adjusted and can be different for different ranges of vertical travel of the slide. Consequently, the range finder and sight can be adjusted to accommodate for different types of targets, different arrows and individual characteristics of the archer.

DETAILED DESCRIPTION

Figure 1:
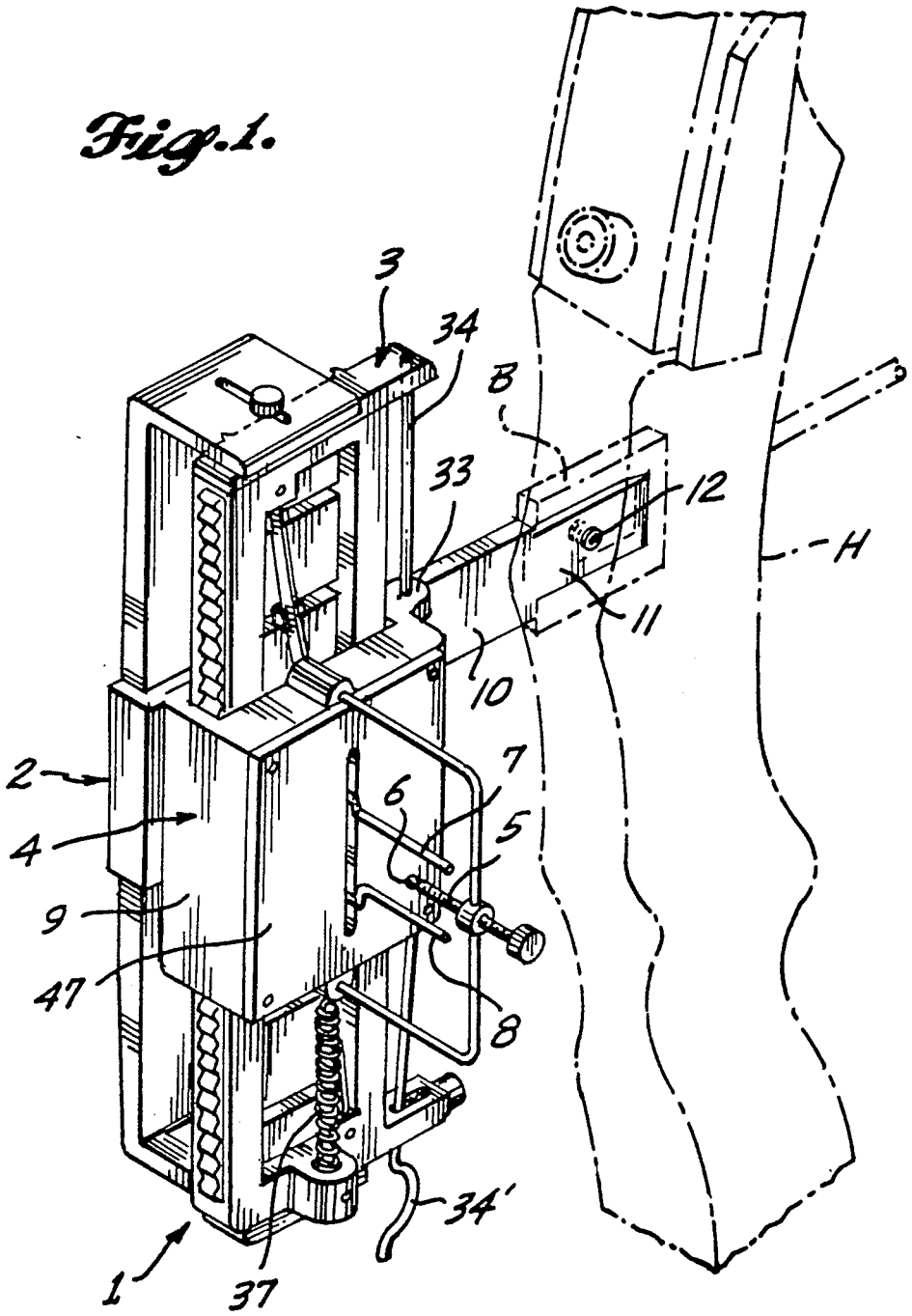
FIG. 1 is a top perspective of an archery bow range finder and sight in accordance with the present invention.

With reference to FIG. 1, the archery bow range finder and sight 1 in accordance with the present invention includes a support bracket 2 mountable on the handle portion H of an archery bow, an upright frame 3 carried by such support bracket and a carriage or slide 4 movable vertically along the upright frame. The slide carries a horizontal sight pin 5 having an end portion 6 in the form of a sight bead to be aligned with the target. The transverse position of the bead 6 can be adjusted but, after adjustment, the bead is stationary relative to the slide housing 9 regardless of the vertical position of such housing. Slide 4 also carries top and bottom range finder pins 7 and 8 which preferably are positioned at equal distances above and below the bead 6, respectively.

The spacing of the range finder pins is adjusted automatically as the slide is moved. Both the initial spacing of the pins 7 and 8 and the degree to which they are moved apart or together for a given travel of the slide can be adjusted. Following initial calibration and adjustment, the archer need only position the slide such that the target appears to fill the space between the pins 7 and 8, whereupon the sight bead will be automatically positioned so as to result in the proper trajectory of the arrow.

For example, as the slide 4 is moved down, the range finder pins are moved equal distances toward the central sight pin 5 and its bead 6. The closer spacing of the range finder pins 7 and 8 corresponds to an increased distance from the archer to the target (the apparent size of the target is smaller at a greater distance). With the sight bead 6 positioned at a lower level, the bow must be swung upward in order to align the bead 6 with the target, which results in an increased angle of trajectory of the arrow.

Similarly, the range finder pins 7 and 8 are automatically moved farther apart by upward movement of the slide 4 along the frame 3, corresponding to the greater apparent size of a closer target, and requiring that the bow be swung downward for a decreased angle of trajectory when the higher sight bead is aligned with the target.

SUPPORT BRACKET CONSTRUCTION

With reference to FIG. 1, the support bracket 2 includes a horizontal cantilever support arm 10 having an inner end portion 11 adapted to be received in the dovetail groove of the standard bow bracket B. Such support arm can be secured in its horizontally extending position by a setscrew 12 which can be loosened for quick uncoupling of the range finder and sight 1 from the bow handle.

Figure 2:
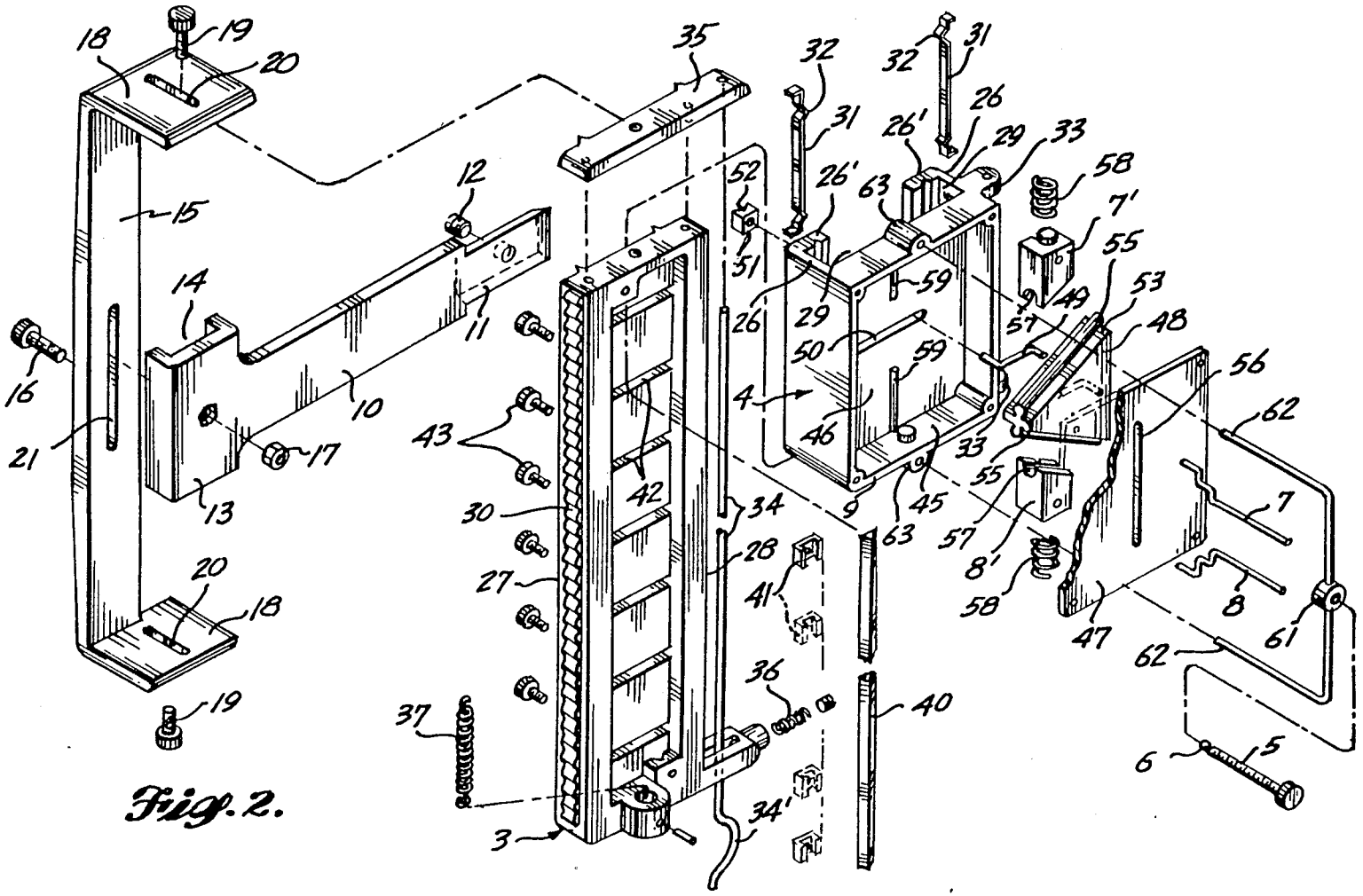
FIG. 2 is a top perspective of the range finder and sight of FIG. 1 with parts in exploded relationship and parts broken away.

As best seen in FIG. 2, the outer end portion 13 of the support arm 10 forms an upright channel 14 for receiving the central portion of a vertical support bar 15. The support bar 15 is secured in the channel by a bolt and nut 16, 17.

Support flanges 18 extend horizontally from the opposite ends of the upright support bar 15 and are connected to the top and bottom of the upright frame 3 by screws 19. The shanks of screws 19 extend through elongated central slots 20 of the flanges 18 such that, with the screws 19 loosened, the position of the frame 3 can be adjusted transversely of the bow. Similarly, the central portion of the support bar 15 has a vertically elongated slot 21 for the shank of the bolt 16 such that, with the bolt loosened, the vertical position of the frame 3 relative to the support arm 10 and the bow handle can be adjusted. Calibration markings can be provided on the flanges 18 adjacent to the slots 20 and on the support bar 15 adjacent to the slot 21 so that the archer can keep track of the appropriate adjustments for a given bow or bows or for different conditions.

FRAME AND SLIDE HOUSING

After adjustment of its position relative to the support bracket support arm 10, the frame 3 is maintained stationarily in upright position relative to the bow handle H. The frame reliably supports and guides the slide 4 for vertical movement relative to the bow handle. In this regard, the internal workings of the slide 4 are carried in the slide housing 9 which has upright flanges 26 that closely embrace the front upright edge 27 and rear upright edge 28 of the frame 3. The free end portions 26' of such flanges 26 are hooked around the frame to form vertical channels 29 receiving the front and rear marginal portions of the frame.

The front and rear edges 27 and 28 of the frame can have closely spaced teeth 30 engaged by inward-facing spring clips 31 carried in the housing channels 29 formed by the housing flanges 26. Such clips 31 can have inward-extending teeth 32 for meshing with the frame teeth 30 to assist in maintaining the slide housing 29 in a desired position to which it is moved manually. In addition, horizontal ears 33 extending rearward from the slide housing 29 have vertical holes slidably receiving an upright resilient rod 34. Rod 34 has its upper portion fixed in a corresponding rearward-extending ear 35 at the top of the frame 3. The bottom end portion of rod 34 has a trigger depression 34' and is biased forward either by the precurved resiliency of the rod and/or by a spring 36. With reference to FIG. 1, the tendency of the rod 34 is for its bottom portion to curve forward out of alignment with the holes in the ears 33 of the slide housing 9. Consequently, although the slide housing is biased downward by a tension spring 37 interconnected between the bottom portion of the frame 3 and the bottom portion of the slide housing, the slide housing is quite firmly maintained in position until the bottom portion of the rod 34 is moved rearward manually so as to straighten the rod, whereupon the slide housing can be moved to a desired position.

In addition to supporting the slide housing 9 for vertical movement, the frame 3 supports an elongated upright cam rail or track 40. In the illustrated embodiment, such track is of triangular cross section and is fitted in dovetail grooves of several small channel members 41 spaced lengthwise of the track 40. One such channel member 41 is provided for each of several horizontal slots 42 which extend fore and aft of the frame 3. Preferably, the slots are evenly spaced along the height of the frame. Setscrews 43 extend through such slots 42 and the channel members 41 to secure the cam track 40 in position adjacent to the slide housing 9.

SLIDE CONSTRUCTION

With reference to FIG. 2, slide housing 9 has a central cavity 45 normally closed by a back wall 46 and a cover plate 47. A composite follower has a body 48 of generally triangular shape mounted in cavity 45 for horizontal movement fore and aft of the cavity (toward and away from the bow handle). Such follower includes a pin 49 extending from the triangular body 48 and through a horizontal slot 50 in the housing back wall 46. Pin 49 carries a small block 51 at the opposite side of the back wall 46. Block 51 has a V-groove 52 closely receiving the cam track 40 of the frame 3, but the block 51 is slidable along the track as the slide housing is moved vertically. Consequently, the horizontal (fore-and-aft) position of the composite follower including the triangular member 48 is determined by the position of the cam track.

The top edge 53 of the triangular body 48 is inclined upward and rearward, and the bottom edge 54 of body 48 is inclined downward and rearward. Each such edge has a central upright tongue 55. Each of two mounting blocks 7' and 8' has an angled edge with a groove 57 to receive the corresponding tongue 55 of the triangular member 48. The range finder pins 7 and 8 extend through a vertical slot 56 in the cover plate 47 into the top and bottom mounting blocks 7' and 8', respectively. Blocks 7' and 8' are biased into engagement with the top and bottom edges 53 and 54 of the triangular follower body 48, such as by compression springs 58. The back face of each block 7' and 8' can have a vertical groove for receiving a corresponding vertical rib 59 projecting from the slide housing back wall 46 to assist in guiding the blocks 7' and 8' for vertical movement.

In addition to the range finder pins 7 and 8 supported on the blocks 7' and 8', there is the central sight pin 5 which can have a threaded shank and a sight bead 6 at one end. The threaded shank of the sight pin extends through a complementally threaded bore of a collar 61 carried on a U-shaped support rod having its opposite ends 62 secured in top and bottom lugs 63 formed on the slide housing 9.

OPERATION

Figure 3:
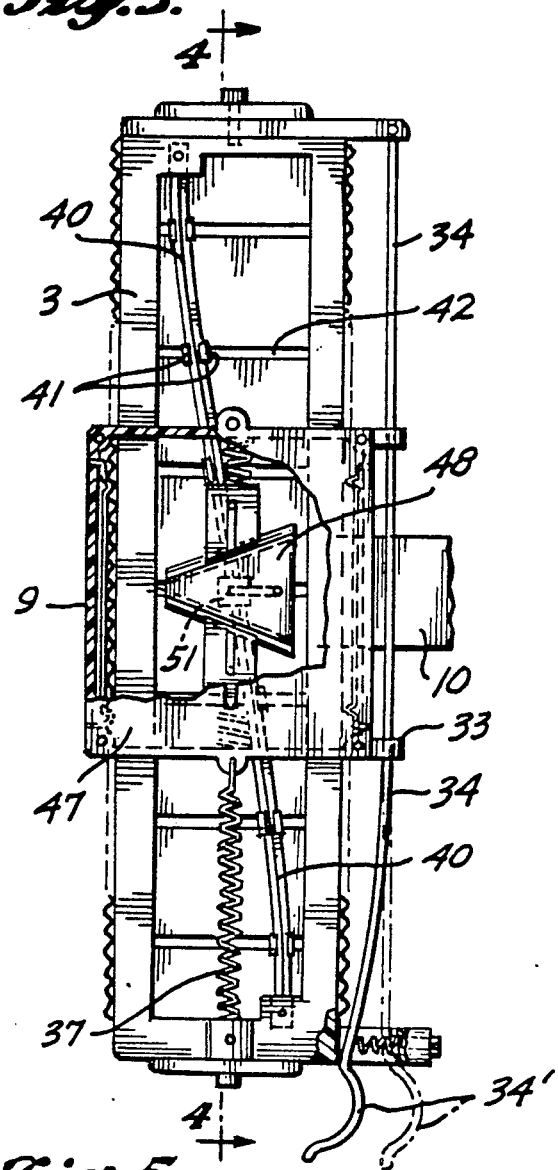
FIG. 3 is a side elevation of the range finder and sight of FIG. 1 with parts broken away.
Figure 4:
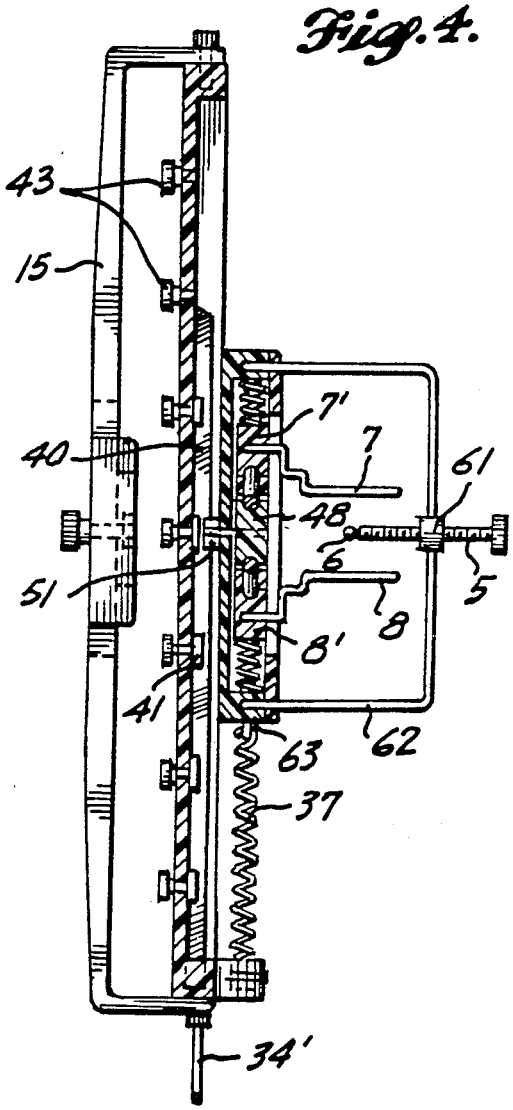
FIG. 4 is a central vertical section along line 4—4 of FIG. 3.
Figure 5:
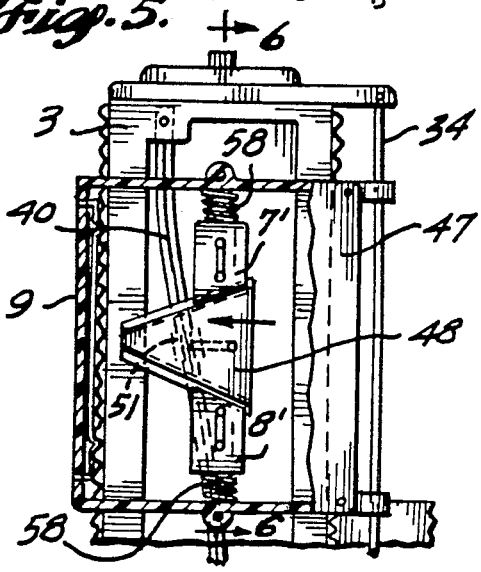
FIG. 5 is a fragmentary side elevation of the upper portion of the range finder and sight of FIG. 1 with parts broken away, corresponding to FIG. 3 but with parts in different positions.
Figure 6:
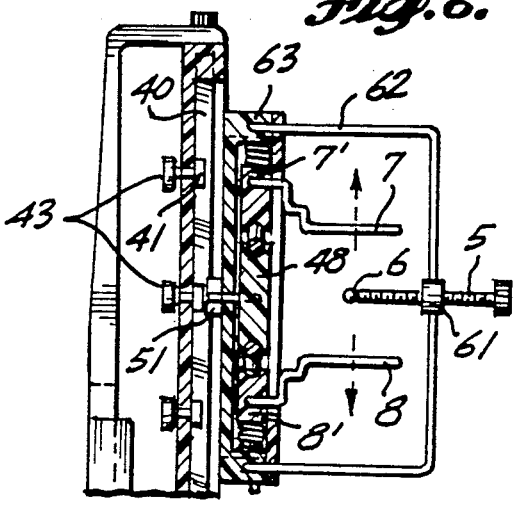
FIG. 6 is a central vertical section along line 6—6 of FIG. 5.

As seen in FIG. 3, the cam track 40 is secured extending generally diagonally of the upright frame 3. With the trigger notch of the resilient guide rod 34 pulled rearward to its broken line position shown in FIG. 3, the slide housing 9 is movable manually along the frame. The grooved block 51 of the follower rides on the cam track 40 and the follower is always centered over the track. Vertical movement of the slide causes the inner triangular portion 48 of the follower to move horizontally. For example, FIG. 5 illustrates the relative positions when the slide is moved to substantially its uppermost position resulting in the follower including the triangular member 48 being shifted to the left from the central position shown in FIG. 3.

Horizontal fore-and-aft movement of the follower 48 is converted into vertical motion of the blocks 7' and 8' which carry the range finder pins 7 and 8. With reference to FIGS. 3 and 5, for example, leftward shifting of the follower 48 as the slide is moved up from the position shown in FIG. 3 to the position shown in FIG. 5 wedges the blocks 7' and 8' apart so as to move the range finder pins 7 and 8 away from the sight pin 5. Downward movement of the slide 4 would result in shifting the follower body 48 to the right as viewed in FIGS. 3 and 5, allowing the blocks 7' and 8' to be moved closer together by the action of the compression springs 58.

As previously described, initial adjustment or calibration can be by adjusting the position of the frame 3 in the support bracket 2 both vertically and horizontally (transversely of the bow). In addition, for a given use, the angle of the cam track relative to the frame can be adjusted by loosening the setscrews 43, moving the cam track to the desired position and tightening the setscrews. Where the same bow is to be used for different types of shooting, calibration markings can be provided on the rear of the frame so that the setscrews can be conveniently set in the correct positions. After calibration of the bow sight and the appropriate adjustments have been made, thereafter the archer need only shift the slide until the apparent size of the target corresponds to the spacing of the range finder pins, whereupon, with the sight bead 6 centered on the target, the bow will automatically be correctly positioned for the proper trajectory of the arrow. Adjustments for different cross winds can be conveniently made by simply turning the sight pin.

I claim:

1. A range finder for an archery bow comprising an elongated frame having a cam member extending generally lengthwise thereof, means for mounting said frame on the bow in upright position extending generally lengthwise of the bow, a slide member movable lengthwise along said frame, a pair of spaced range finder pins, a cam follower member carried by said slide member and including a portion engageable by said cam member of said frame for adjusting the position of said follower member in a direction transversely of said frame as said slide member is moved along said frame, and pin-mounting means carried by said slide member and carrying said range finder pins, said pin-mounting means being moved by said cam follower member so as to adjust the spacing between said pins based on the position of said cam member of said frame relative to said slide member.

2. The range finder defined in claim 1, including a sight member separate from the range finder pins and mounted on the slide member independently of mounting of the range finder pins, said sight member being positioned between the range finder pins.

3. The range finder defined in claim 2, in which the sight member is mounted so as to be maintained normally stationary relative to the slide member.

4. The range finder defined in claim 2, in which the follower member and the pin-mounting means are constructed and arranged relatively such that vertical movement of the slide member along the frame results in movement of each range finder pin relative to the sight member a distance equal to movement of the other range finder pin relative to the sight member.

5. The range finder defined in claim 1, in which the frame is generally rectangular, the cam member extending generally diagonally of the frame, the follower member including a generally triangular block carried by the slide member and having an inclined edge extending generally transversely of the frame for riding along the cam member so as to shift in the slide member in a direction generally transversely of the frame by vertical movement of the slide along the frame, the pin-mounting means including a block carrying a range finder pin biased toward said inclined edge of said follower member and having a portion engaged against said surface such that transverse shifting of the following member effects vertical shifting of said block relative to the slide member.

6. A range finder for an archery bow comprising an elongated frame having a cam track extending generally lengthwise thereof, means for mounting said frame on the bow in upright position with its cam track extending generally vertically in a plane generally parallel to the central plane of the bow but at an angle relative to the bow such that different portions of said cam track are located at different distances from the bow in a fore-and-aft direction, a follower member movable lengthwise along said cam track and engaged thereby for shifting of said follower member toward and away from the bow depending on the position of said follower member along said cam track, a pair of range finder pins, and means carrying said pins and engaged against said follower member for adjusting the spacing of the pins based on the position of the follower member determined by its position along the length of the cam track.

7. The range finder defined in claim 6, in which the follower member has top and bottom inclined surfaces, the pin-mounting means including blocks mounted above and below the follower member, respectively, said blocks carrying the range finder pins, respectively, means biasing said blocks toward the follower member and mounting said blocks for movement relative to said top and bottom inclined edges thereof as the follower member is shifted, whereby shifting of said follower member in one direction tends to wedge said blocks and their range finder pins apart, whereas shifting of said follower member in the opposite direction permits movement of said blocks together by force of the biasing means for decreasing the spacing between the range finder pins.

8. The range finder defined in claim 7, including means for adjusting the angle of the cam track for adjusting the amount of change in the spacing between the range finder pins for a given distance of travel of the follower member along the cam track.

9. The range finder defined in claim 6, including a sight member positioned between the range finder pins and mounted independently of the range finder pins.

10. A range finder and sight for an archery bow comprising an elongated frame having a cam member extending generally lengthwise thereof, means for mounting said frame on the bow in upright position extending generally lengthwise of the bow, a slide member movable lengthwise along said frame, said slide member including a housing and a cam follower member mounted in said housing for movement relative to said housing as determined by the position of said cam member relative to said housing, a sight pin carried by said slide member and normally maintained substantially stationarily relative thereto, a pair of range finder pins disposed, respectively, at opposite sides of said sight pin, and pin-mounting means carrying said range finder pins and mounted in said slide housing, the vertical position of said pin-mounting means relative to said slide housing being determined by the position of said follower member and being constructed and arranged relatively such that movement of said slide member along said frame results in adjustment of the vertical position of each of the range finder pins relative to the sight pin by moving said pins in opposite directions equal distances for a given length of vertical movement of said slide member along said frame

11. The range finder and sight defined in claim 10, including means for adjusting the amount of vertical movement of the range finder pins relative to the sight pin for a given distance of travel of the slide member along the frame.

12. The range finder and sight defined in claim 10, including means for normally maintaining the slide member substantially stationary relative to the frame but releasable for manual adjustment of the position of the slide member along the frame.

13. The range finder and sight defined in claim 10, including means for adjusting the position of the frame relative to the frame mounting means.

* * * * *